US005799866A

United States Patent [19]

Hattem

[11] Patent Number: 5,799,866

[45] Date of Patent: Sep. 1, 1998

[54] HOUSEHOLD FOOD CONTAINER

[76] Inventor: Deeb Hattem, 2701 Castlebluff Ct., SE. #104, Grand Rapids, Mich. 49512

[21] Appl. No.: 726,269

[22] Filed: Oct. 4, 1996

[51] Int. Cl.[6] ..... B65D 1/36; B65D 1/24

[52] U.S. Cl. ..... 229/406; 206/563; 220/574; 229/120.32; 229/407

[58] Field of Search ..... 229/120.32, 406, 229/407; 220/574, 575, 625, 694; 206/204, 562, 563; 426/129; 209/259, 260, 235, 352, 370, 372, 373, 374, 376, 414, 417, 479, 614

[56] References Cited

U.S. PATENT DOCUMENTS

| | | | |
|---|---|---|---|
| 885,475 | 4/1908 | Hitchcock | 220/574 |
| 1,776,558 | 9/1930 | Herman . | |
| 2,613,011 | 10/1952 | Foreshaw-Smith . | |
| 2,814,381 | 11/1957 | Stevick | 220/367.1 |
| 3,025,948 | 3/1962 | Appelt | 206/563 |
| 3,026,209 | 3/1962 | Niblack et al. | 426/129 |
| 3,288,346 | 11/1966 | Peppler | 229/407 |
| 3,297,191 | 1/1967 | Eastman | 229/120.32 |
| 3,507,667 | 4/1970 | Magnen | 99/171 |
| 3,516,596 | 6/1970 | Madden et al. . | |
| 3,756,681 | 9/1973 | Croston | 426/129 |
| 3,778,516 | 12/1973 | Cornelius | 426/119 |
| 4,307,808 | 12/1981 | Johnson | 209/614 |
| 4,588,087 | 5/1986 | Swingley | 206/509 |
| 4,610,348 | 9/1986 | Dailey | 206/563 |
| 4,616,748 | 10/1986 | Thomas | 206/214 |
| 4,807,776 | 2/1989 | Cortopassi | 220/23.83 |
| 4,889,619 | 12/1989 | Lynch | 209/352 |
| 5,139,166 | 8/1992 | Smith | 220/574 |
| 5,174,453 | 12/1992 | Stoeffler | 206/570 |
| 5,219,091 | 6/1993 | Paramiski | 220/580 |
| 5,333,751 | 8/1994 | Santucci, Sr. | 229/120.32 |
| 5,335,844 | 8/1994 | Young . | |
| 5,407,648 | 4/1995 | Allen et al. | 206/563 |
| 5,540,334 | 7/1996 | Haas et al. | 206/563 |

*Primary Examiner*—Gary E. Elkins
*Attorney, Agent, or Firm*—Robert J. Sayfie

[57] ABSTRACT

The present invention relates to a food storage device that is capable of storing food items for an extended period of time. This device includes a bottom wall that has a sidewall extending upward from its periphery forming a cavity therein. A removable platform is further contained within the cavity capable of supporting food items therein. The removable platform supported within the cavity by a support structure. The support structure embodied by either legs extending downward from the removable platform, pegs extending upward from the bottom wall or a ridge extending inwardly from the sidewall. The cavity is enclosed by a cover that is removably attached to the sidewall.

5 Claims, 1 Drawing Sheet

HOUSEHOLD FOOD CONTAINER

BACKGROUND OF THE INVENTION

1. Field of the Invention

The present invention relates generally to a food container, more particularly, the present invention relates to a food container device capable of storing food item such as fruits and vegetables for an extended period of time.

2. Description of Prior Art

Consumers often store food items such as fruits and vegetables in various types of containers with or without refrigeration. Often, if the food items stay in the containers for an extended period of time, it spoils due to the lack of moisture. The prior art discloses a number of food containers that are capable of storing food items for an extended period of time. The problem with the prior art containers is that they are designed to be used for commercial transportation and storage only. These commercial containers are often to large and expensive for home use. Therefore, there exists a need for a food container capable of storing food items for an extended period of time that is compact and cost effective enough to be used by the average home consumer.

Numerous innovations for food containers have been provided in the prior art that are described as follows. Even though these innovations may be suitable for the specific individual purposes to which they address, they differ from the present invention as hereinafter contrasted.

U.S. Pat. No. 3,507, 667 to Magnen, U.S. Pat. No. 3,516,596 to Madden et al., U.S. Pat. No. 3,778,516 to Cornelius, U.S. Pat. No. 4,558,087 to Swingley, Jr., U.S. Pat. No. 5,219,091 to Paramiski and U.S. Pat. No. 5,335,844 to Young each disclose food containers. Magnen discloses a fruit and vegetable container composed of a bag of flexible container. Madden et al. discloses a produce container composed of an air tight foamed polystyrene enclosure encased within a cardboard box. Cornelius discloses an interlocking fruit container composed of a bottom wall with an upwardly and outwardly extending side wall, and the bottom wall further having a locating structure at its center. Swingley, Jr. discloses a fruit container having a bottom opening surrounded by raised rims, side openings and weep holes to allow ventilation without uncontrolled dripping. Paramiski discloses a container having a cover displaceably mounted to the sidewall for varying the volume of the container to dispense food in the fluid form. Young discloses a corrugated container for storing and transporting produce having a bottom member, a plurality of planar first members extending from the bottom member and defining walls. These patents differ from the present invention because they do not disclose a container having a removable platform contained therein for supporting produce in water adopted for home use.

U.S. Pat. No. 4,807,776 to Cortopassi discloses a food container for transport. This container has separate compartments to prevent the food item from mixing together. The Cortopassi Patent lacks the apertures in part number 14 required for evaporation. Further the Cortopassi Patent could not function as the applicant's invention. The applicant's invention can hold water to be at a level below, or above the support tray (114, 214, or 314) due to the apertures. In the Cortopassi patent, the upper tray member (14) would have a tendency to float above the water if light-weight food items (sprouts) were placed on it. Further the tray member (14) in the Cortopassi Patent does not allow for the evaporation function such as the applicants.

U.S. Pat. No. 1,776,558 to Herman discloses a patent which is structurally distinguished from applicant's invention. In the Herman Patent, the auxiliary receptacle (3) is not a water-tight receptacle. The applicant's invention contains a receptacle which is water-tight. This allows for either the water to be placed at a level below the food items in the container, or above the level of the food items, depending on the consumer's desire. Further, the Herman patent false bottom (6) has a purpose and function to keep the pickles above the water after draining. The false bottom (6) is located near the bottom of the receptacle. Reference to the drawings in the Herman patent is necessary to understand and interpret the invention. Fromson v Advance Offset Plate, Inc., 720 F.2d 1565, 1569–70, 219 USPQ 1137, 1140 (Fed. Cir. 1983). The Herman false bottom (6) is very close to the bottom of the receptacle so liquid can drain out of the receptacle, and the pickles can rest out of the liquid. In the applicants invention, the removable platform (114, 214, or 314) can be placed at the center of the cavity, near the top, or bottom of the cavity. Also, a key object of the present invention is that it is designed to easily fit between refrigerator shelving, unlike the Herman patent.

U.S. Pat. No. 4,616,748 to Thomas et. al., discloses a container for storing pastels. The Thomas Patent is not a water-tight container, and is not designed for holding water or evaporation. The cover on the Thomas Patent would prevent evaporation if it could contain water. The applicant's invention has a water-tight cavity and this is the main distinction between the two patents.

U.S. Pat. No. 2,613,011 to Foreshaw-Smith discloses a skin lotion container. The Foreshaw-Smith Patent requires a screw-top lid, so the user can shake the device. Also the Foreshaw-Smith patent requires a perforated false bottom (E) which fits closely to the side walls as to prevent any liquid from rising up the side walls. In the applicant's invention, the removable platform (114, 214, or 314) is specifically loose fitting for ease of removing and inserting the platform. The platform in the applicant's invention also rests loosely within the side walls. The screw top lid of the Foreshaw-Smith patent, is required to withhold any cleansing liquid when shaken. The applicant's invention has one embodiment in which apertures are required on the top to allow for better evaporation.

U.S. Pat. No. 5,174,453 to Stoeffier discloses a surgical tray cleaning system or storage system. The Stoeffler Patent is not a water-tight container unlike the applicant's invention. The applicant's invention is required to be a water-tight cavity.

Numerous innovations for food containers have been provided in the prior art that are adapted to be used. Even though these innovations may be suitable for the specific individual purposes to which they address, they would not be suitable for the purposes of the present invention as heretofore described.

SUMMARY OF THE INVENTION

In according with the present invention, the household food container consists of a bottom portion, platform and a cover. The bottom portion comprised of a bottom wall and a side wall extending upward forming a cavity therein. Contained and supported within the cavity of the bottom portion is the removable platform providing support therein. The platform further having a plurality of apertures through its surface allowing water and moisture to pass through. The cover removably attached to the bottom portion preventing moisture from escaping therefrom.

Broadly considered, the invention comprises a food container capable of storing food items for an extended period of time with or without refrigeration. The food items are supported by the platform within the covered bottom portion cavity, which is filled with water. When the cavity is filled with water below the level of the platform, moisture will evaporate through the platform apertures, thereby allowing the food item to absorb moisture and breath. When the cavity is filled with water above the level of the platform, water will evaporate through the platform apertures, thereby allowing the food item to absorb moisture and breath. Allowing the food items to absorb the moisture and breathe will extend the time they can be kept fresh within the household food container. Accordingly, it is an object of the present invention to provide a food container.

More particularly, it is an object of the present invention to provide a household food container capable of storing food item such as fruits and vegetables and water. In keeping with these objects, and with others which will become apparent hereinafter, one feature of the present invention resides, briefly stated, in that the household food container is capable of storing food items for an extended period of time with or without refrigeration.

When the portable household food container is designed in accordance with the present invention, it can provide the average consumer with an economical and affective way to store or transport food items such as fruits and vegetables.

In accordance with another feature of the invention, the home food container allows the food items to absorb moisture and breath, thereby extending the period of time they can be stored in the home food container.

Another feature of the present invention is that the lower portion has a cavity capable of storing water.

Yet another feature of the present invention is that it contains a removable platform that supports the food items within the cavity and allows easy removal for cleaning of the household food container.

Still another feature of the present invention is that the removable platform has a plurality of apertures for passing moisture through.

Yet still another feature of the present invention is that the cover provides an air tight seal to prevent moisture from escaping from the cavity.

Still another feature of the present invention is that the household food container can be fabricated from a material selected from a group consisting of plastic, plastic composites, fiberglass, plexiglass, stainless steel, epoxy, carbon-graphite, glass, tempered glass, lucite, wood, stone, metal, metal alloys and rubber composites.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

FIRST EMBODIMENT

110—first household food container 110
112—first bottom portion 112
114—first removable platform 114
114A—removable platform legs 114A
114B—first removable platform notches 114B
114C—first removable platform apertures 114C
116—first cover 116
116A—first cover sealant lip 116A

SECOND EMBODIMENT

210—second household food container 210
212—second bottom portion 212
212A—bottom portion pegs 212A
214—second removable platform 214
214A—second removable platform apertures 214A
214B—second removable platform notches 214B
216—second cover 216
216A—second cover sealant lip 216A

THIRD EMBODIMENT

310—third household food container 310
312—third bottom portion 312
312A—third bottom portion ridge 312A
314—third removable platform 314
314A—third removable platform apertures 314A
314B—third removable platform notches 314B
316—third cover 316
316A—third cover sealant lip 316A

BRIEF DESCRIPTION OF THE PREFERRED EMBODIMENT

DETAILED DESCRIPTION OF THE PREFERRED EMBODIMENT

Figures 1, 2, 3, 4:
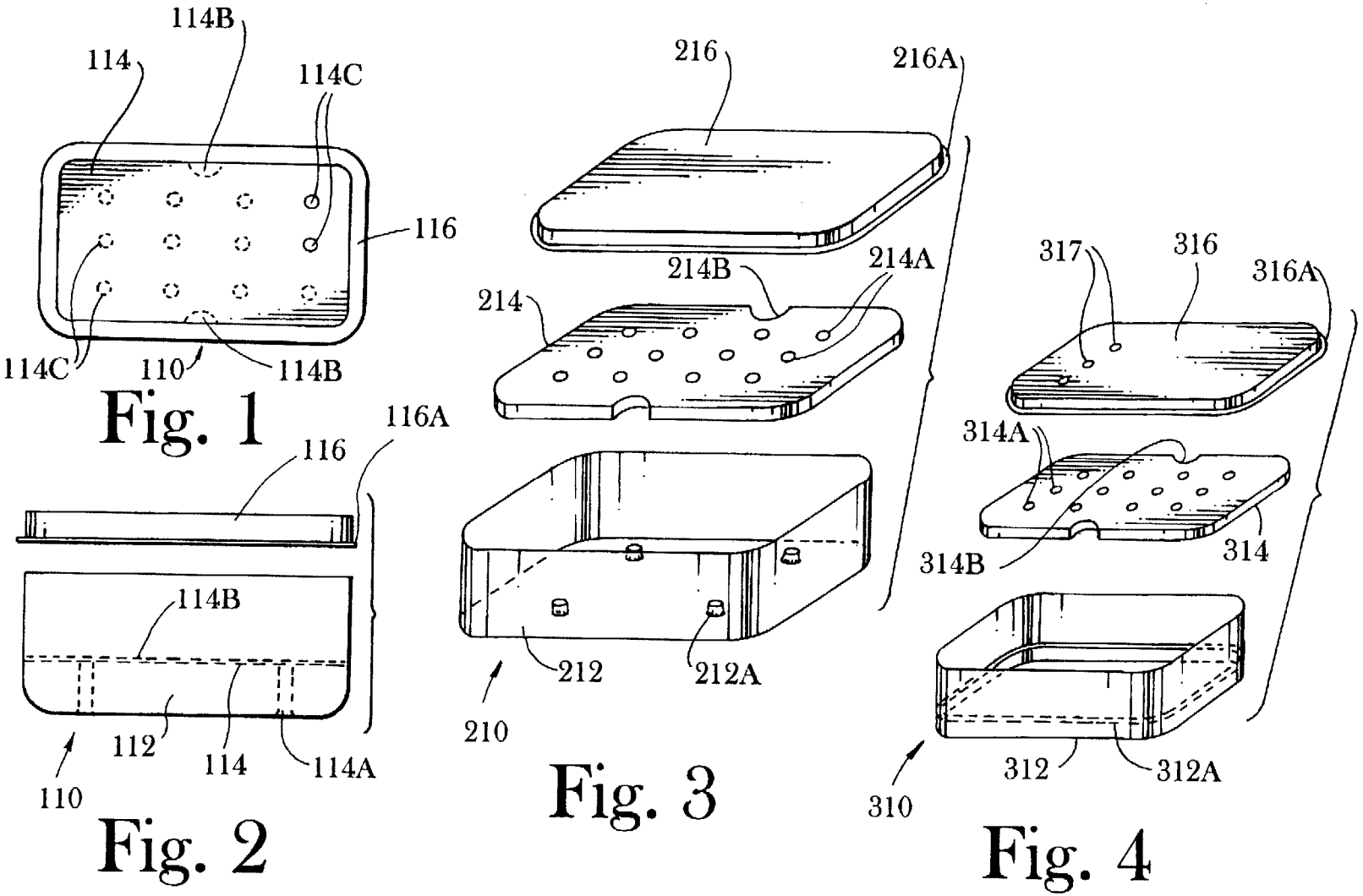
FIG. 1 is a top view of the first embodiment of the household 110 food container assembled.
FIG. 2 is a front view of the first embodiment of the household food container having the first removable platform placed within the first lower portion and the first cover removed.
FIG. 3 is an exploded view of the of the second embodiment of the household food container.
FIG. 4 is an exploded view of the third embodiment of the household food container.

Firstly, referring to FIG. 1 which is a top view of the first embodiment of the household food container 110 assembled exhibiting the following features: first removable platform 114; first removable platform notches 114B; first removable platform apertures 114C; and first cover 116. The first cover 116 is shown being disposed above the first removable platform 114. The first removable platform 114 has a plurality of first removable platform apertures 114C extending through its surface vertically. The first removable platform apertures 114C allows evaporating moisture or water to pass through them, thereby providing moisture to the food items. Located on the top edge and the bottom edge of the first removable platform 114 are the two first removable platform notches 114B. The first removable platform notches 114B provides the user with an adequate open space to grasp the edge of the first removable platform 114, thereby allowing easy removal.

Referring to FIG. 2 which is a front view of the first embodiment of the household food container 110 having the first removable platform 114 placed within the first bottom portion 112 and the first cover 116 removed exhibiting the following features: first bottom portion 112; first removable platform 114; removable platform legs 114A; first removable platform notches 114B; first cover 116; and first cover sealant lip 116A.

The first lower portion 112 consists of a bottom wall. Integrally extending upward from the entire periphery of the bottom wall is a side wall forming a cavity therein. The cavity provides the space to store the water and to place the first removable platform 114 therein.

The first removable platform 114 shown within the cavity of the first bottom portion 112 provides a flat surface that supports the food items being stored. The first removable platform 114 has the first removable platform notches 114B and the first removable platform apertures 114C as discussed above. Extending downward from the bottom surface of the first removable platform 114 are the four removable platform legs 114A, which supports the first removable platform 114 within the cavity of the bottom portion 112. The removable platform legs 114A are one embodiment of the supporting means. The first removable platform 114 was designed to be removable to allow the first household food container 110 to be easily cleaned.

The first cover 116 removably attaches to the top edge of the bottom portion 112, thereby preventing any moisture from escaping from the cavity of the bottom portion 112. Extending downward from the first cover 116 is the first cover sealant lip 116A. The first cover sealant lip 116A is designed to mate to the top edge of the bottom portion 112, thereby providing an air tight seal therebetween.

When the first embodiment of the household food container 110 is being used, the first removable platform 114 will be replaced within the cavity of the first bottom portion 112. Then the cavity of the first bottom portion 112 will be filled with water. The food items to be stored will be placed within the cavity of the first bottom portion 112 and disposed on top of the first removable platform 114. Then the cover will be attached to the first bottom portion 112 covering the cavity. The water within the cavity of the first bottom portion 112 will provide moisture to the food items, which will allow them to be stored within the first embodiment of the household food container 110 for an extended period of time. When the water level within the cavity of the first bottom portion 112 is below the level of the first removable platform 114, the food items will receive moisture by water evaporating through the first removable platform apertures 114C. When the water level within the cavity of the first bottom portion 112 is above the level of the first removable platform 114, the food items will receive moisture by water passing through the first removable platform apertures 114C.

Referring to FIG. 3 which is an exploded view of the of the second embodiment of the household food container 210 exhibiting the following features: second bottom portion 212; bottom portion pegs 212A; second removable platform 214; second removable platform apertures 214A; second removable platform notches 214B; second cover 216; and second cover sealant lip 216A. The second embodiment of the household food container 210 is exactly the same as the first embodiment except that the second removable platform 214 is supported within the second bottom portion 212 by a different supporting means. This supporting means is embodied by the four bottom portion pegs 212A, which extend upward from the top surface of each corner of the bottom side of the second bottom portion 212. When being used, the second removable platform 214 is placed on the four bottom portion pegs 212A, thereby being supported within the cavity of the second bottom portion 212.

Referring to FIG. 4 which is an exploded view of the of the third embodiment household food container 310 exhibiting the following features: third bottom portion 312; third bottom portion ridge 312A; third removable platform 314; third removable platform apertures 314A; third removable platform notches 314B; third cover 316; and third cover sealant lip 316A. The third embodiment of the household food container 310 is exactly the same as the first embodiment except that the third removable platform 314 is supported within the third bottom portion 312 by a different supporting means. This supporting means is embodied by the third bottom portion ridge 312A, which is a ridge that extends inwardly from the inner surface of the side wall of the third bottom portion 312. When being used, the third removable platform 314 is placed on the third bottom portion ridge 312A, thereby being supported within the cavity of the third bottom portion 312.

The first embodiment household food container 110, second embodiment household food container 210 and third embodiment household food container 310 each can be completely fabricated from a material selected from a group consisting of plastic, plastic composites, fiberglass, plexiglass, stainless steel, epoxy, carbon-graphite, glass, tempered glass, lucite, wood, stone, metal, metal alloys and rubber composites.

It will be understood that each of the elements described above, or two or more together, may also find a useful application in other types of constructions differing from the type described above.

While the invention has been illustrated and described as embodied in a household storage container, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A food container device comprising:

a) a bottom wall;

b) a sidewalls extending circumferentially and upwardly from a periphery of the bottom wall forming a cavity therein;

c) a removable platform contained within the cavity for supporting food items within the cavity;

d) a means for supporting the removable platform within the cavity;

e) a cover removably attached to an upper distal end of the sidewall; and f) wherein the supporting means is a continuous uninterrupted ridge extending inwardly and completely around on the inside of the sidewall.

2. The food container device of claim 1, wherein the removable platform has slots contained on an outer periphery of the removable platform.

3. The food container device of claim 1, wherein the cover has a lip extending downward for providing an air tight seal between the sidewall and cover.

4. The food container device of claim 1, wherein the bottom wall, side wall, removable platform, supporting means and cover are fabricated from a material selected from a group consisting of plastic, plastic composites, fiberglass, plexiglass, stainless steel, epoxy, carbon-graphite, glass, tempered glass, lucite, wood, stone, metal, metal alloys and rubber composites.

5. The food container device of claim 1, wherein the cover has apertures to allow for aeration and evaporation.

* * * * *